US010820107B2

(12) United States Patent
Feng

(10) Patent No.: US 10,820,107 B2
(45) Date of Patent: Oct. 27, 2020

(54) SPEAKER

(71) Applicant: AAC Technologies Pte. Ltd., Singapore (SG)

(72) Inventor: Dai Feng, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/526,939

(22) Filed: Jul. 30, 2019

(65) Prior Publication Data

US 2020/0045445 A1 Feb. 6, 2020

(30) Foreign Application Priority Data

Aug. 3, 2018 (CN) ..... 2018 2 1245725 U

(51) Int. Cl.

| | |
|---|---|
| ***H04R 1/02*** | (2006.01) |
| ***H04R 9/04*** | (2006.01) |
| ***H04R 9/06*** | (2006.01) |
| ***H04R 9/02*** | (2006.01) |

(52) U.S. Cl.

CPC ..... *H04R 9/041* (2013.01); *H04R 9/025* (2013.01); *H04R 9/06* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 9,813,821 | B1 * | 11/2017 | Song | H04R 9/06 |
| 2014/0153771 | A1 * | 6/2014 | Ohashi | H04R 9/025 381/412 |
| 2014/0254858 | A1 * | 9/2014 | He | H04R 9/046 381/398 |
| 2015/0189442 | A1 * | 7/2015 | Zhang | H04R 9/025 381/409 |
| 2016/0100254 | A1 * | 4/2016 | Bae | H04R 9/043 381/354 |

* cited by examiner

*Primary Examiner* — Olisa Anwah

(74) *Attorney, Agent, or Firm* — W&G Law Group LLP

(57) ABSTRACT

A speaker includes a frame having a receiving space, a vibration unit received in the receiving space, and a magnetic circuit unit for driving the vibration unit to vibrate and emit sound. The vibration unit includes a first diaphragm configured to vibrate and emit sound, and a voice coil for driving the first diaphragm to vibrate and emit sound. The speaker further includes a centering support sandwiched between the first diaphragm and the voice coil. In the speaker according to the present disclosure, by sandwiching the centering support between the voice coil and the first diaphragm, a positional conflict between the centering support and the main magnet is avoided, the main magnet can have an increased size, thereby enhancing the space utilization and sensitivity of the speaker, and improving the acoustic performance of the speaker.

9 Claims, 4 Drawing Sheets

SPEAKER

TECHNICAL FIELD

The present disclosure relates to the acoustoelectric field, and in particular, to a speaker.

BACKGROUND

In order to adapt to miniaturization and multi-functional development of various audio devices and communication devices, speakers used in these devices are required to be more miniaturized accordingly. Therefore, higher requirements are raised for the space utilization and acoustic performance of the speakers.

In the related art, the centering support of the speaker is disposed below the voice coil and sandwiched between the second diaphragm and the voice coil, and the centering support is fixedly connected to a short side wall of the frame. With such a design, in order to avoid a contact with the connecting arms of the centering support, the size of the main magnet usually needs to be reduced, which greatly limits the size of the main magnet and affects the sensitivity of the magnetic circuit unit of the speaker.

Therefore, it is urgent to provide a novel speaker to solve the above technical problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding portions throughout the several views.

DESCRIPTION OF EMBODIMENTS

The present invention will be further illustrated with reference to the accompanying drawings and the embodiments.

Figure 1:
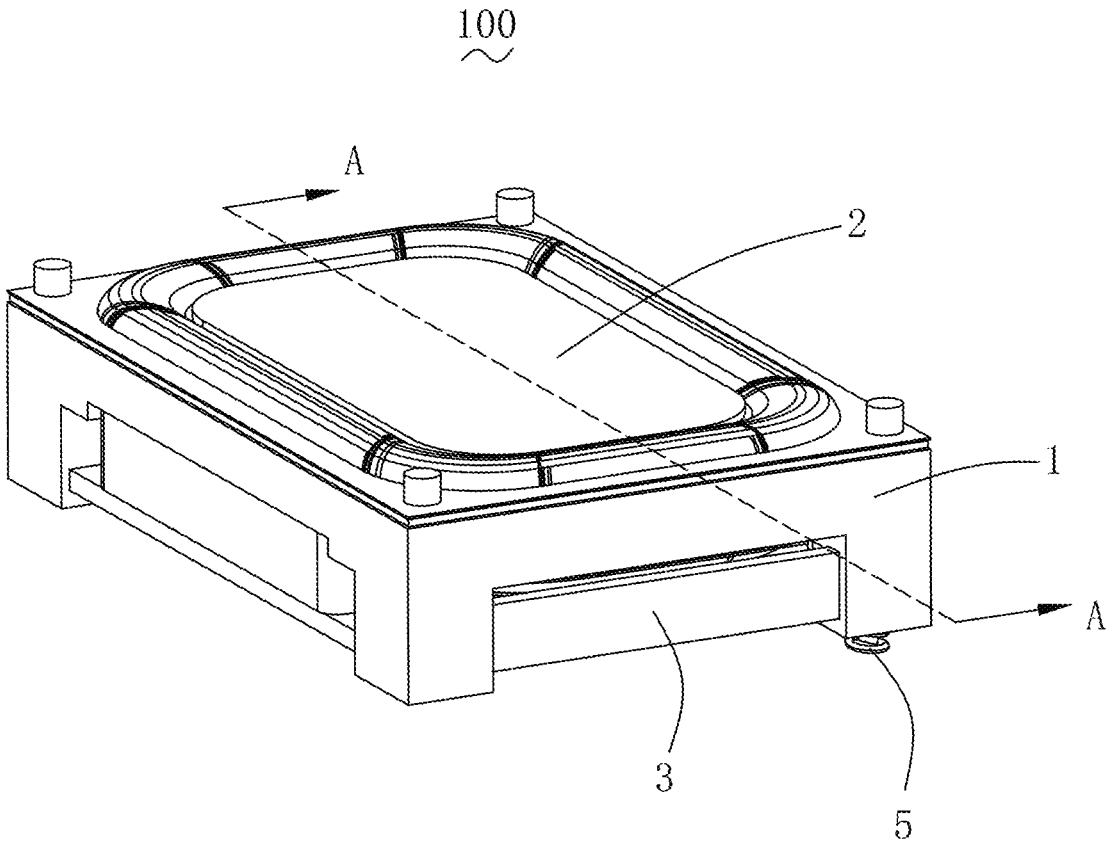
FIG. 1 is a perspective structural schematic diagram of a speaker according to the present disclosure.
Figure 2:
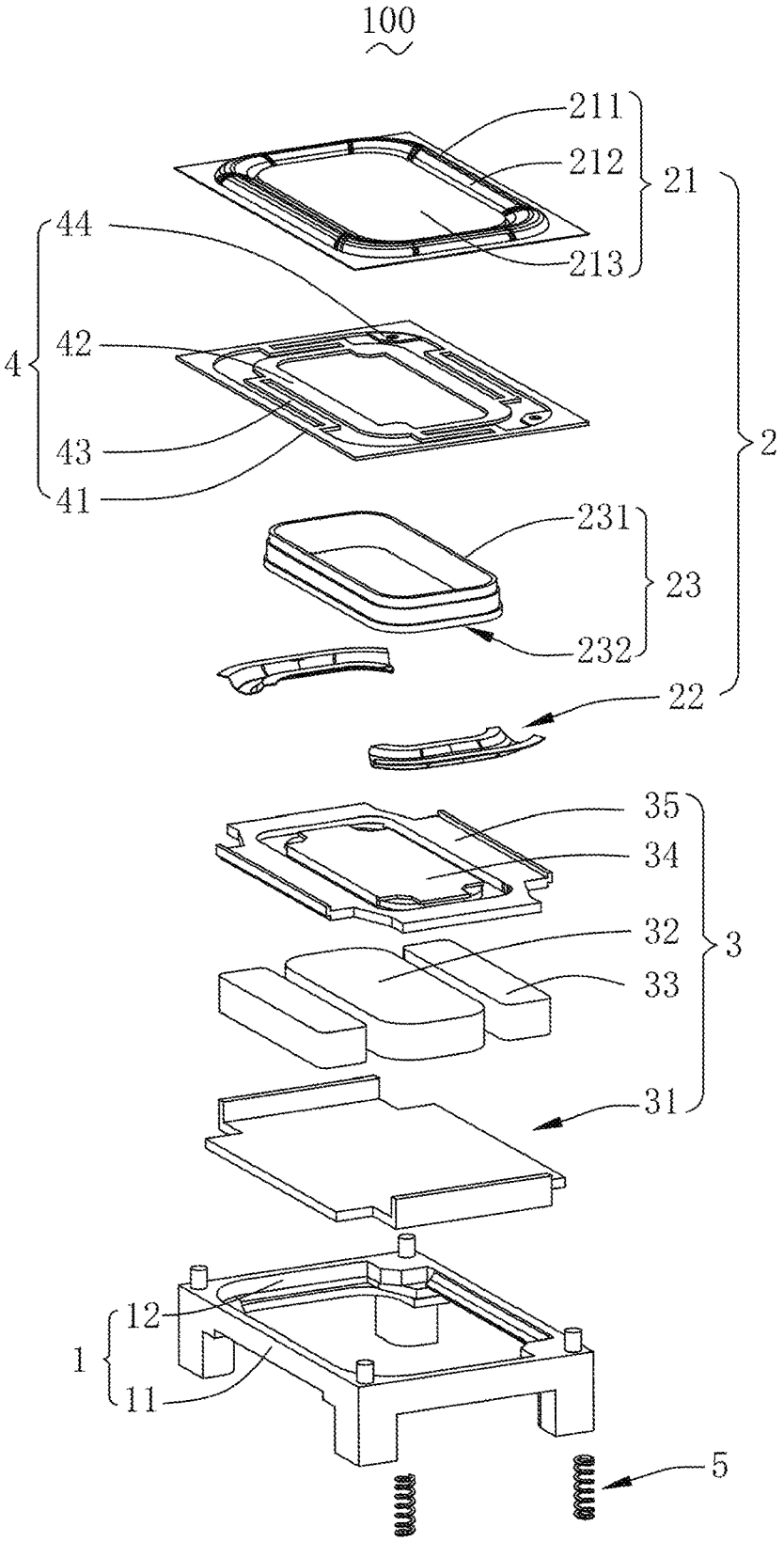
FIG. 2 is an exploded view of the speaker as shown in FIG. 1.
Figure 3:
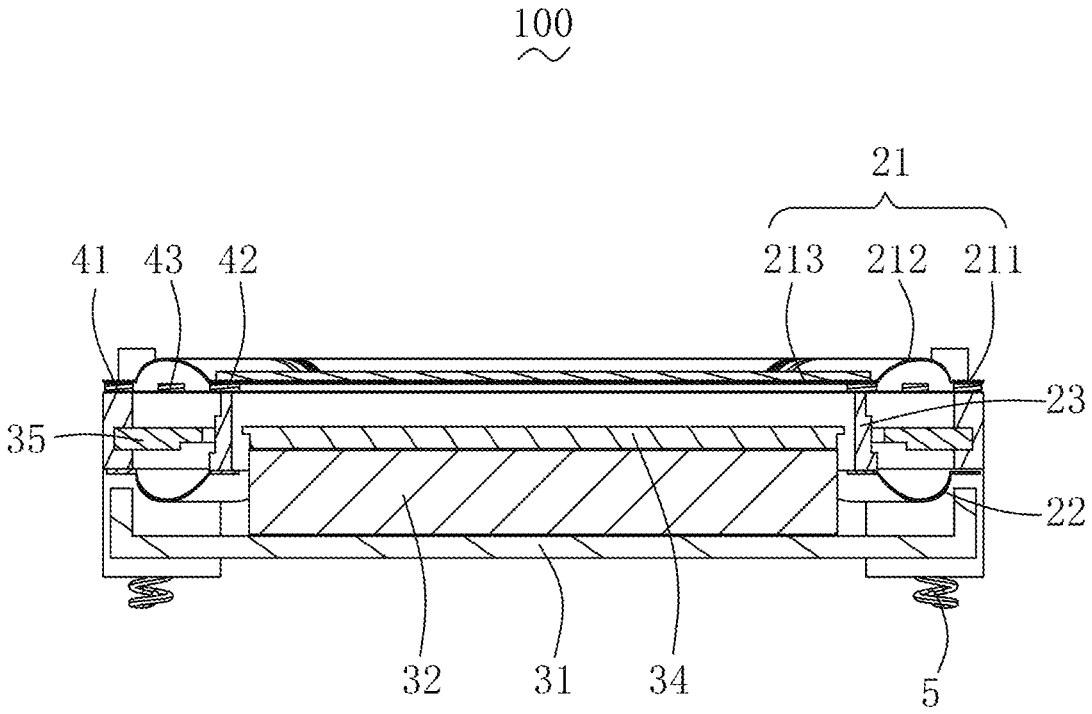
FIG. 3 is a cross-sectional view of the speaker taken along line A-A as shown in FIG. 1.

Referring to FIG. 1 to FIG. 3, the present disclosure provides a speaker 100. The speaker 100 includes a frame 1 having a receiving space, a vibration unit 2 received in the receiving space, a magnetic circuit unit 3 for driving the vibration unit 2 to vibrate and emit sound, a centering support 4, and a conductive terminal 5 for electrically connecting the speaker 100 with outside.

The frame 1 is configured to receive and protect other devices of the speaker 100.

The frame 1 has a shape of a rectangular frame, which includes two long side walls 11 spaced apart from each other in parallel, and two short side walls 12 respectively arranged at two ends of the two long side walls 11 and connected to the two long side walls 11. The long side walls 11 and the short side walls 12 are connected end to end in sequence to form the receiving space of the frame 1.

The vibration unit 2 is configured to vibrate and emit sound. For example, the vibration unit 2 includes a first diaphragm 21 configured to vibrate and emit sound, a second diaphragm 22 disposed opposite to the first diaphragm 21, and a voice coil 23 connected to the second diaphragm 22 and configured to drive the first diaphragm 21 to vibrate and emit sound. One end of the second diaphragm 22 is fixedly connected to the frame 1, and the other end is fixedly connected to the voice coil 23. The second diaphragm 22 elastically supports the voice coil 23, thereby improving the acoustic performance of the speaker 100.

The first diaphragm 21 includes a fixing portion 211 connected to the centering support 4, a suspension portion 212 connected to the fixing portion 211, and a dome portion 213 connected to the suspension portion 212. Specifically, a cross-section of the suspension portion 212 is an arc structure protruding in a direction facing away from the frame 1. The suspension portion 212 is circularly arranged around the dome portion 213 and connects the dome portion 213 with the fixing portion 211.

The voice coil 23 includes an upper surface 231 close to the first diaphragm 21 and a lower surface 232 disposed opposite to the upper surface 231. The centering support 4 is attached to the upper surface 231, and the second diaphragm 22 is attached to the lower surface 232.

The magnetic circuit unit 3 is configured to drive the vibration unit 2 to vibrate and emit sound. For example, the magnetic circuit unit 3 includes a yoke 31 fixedly connected to the frame 1, a main magnet 32 assembled at the center of the yoke 31, auxiliary magnets 33 assembled on the yoke 31 and surrounding the main magnet 32 to form a magnetic gap, a main pole plate 34 attached above the main magnet 32, and an auxiliary pole plate 35 attached to the auxiliary magnets.

In this embodiment, the yoke 31 is of a bowl structure, and the main magnet 32 is attached to the center of the yoke 31. The auxiliary magnet 33 is in a long-strip shape, the number thereof is two. The two auxiliary magnets 33 are symmetrically disposed at two sides of the main magnet 32. The main magnet 32 and the auxiliary magnets 33 are spaced apart to form the magnetic gaps, and the voice coil 23 is suspended in the magnetic gaps.

The main pole plate 34 and the auxiliary pole plate 35 are made of a permeability magnetic material, and thus have a permeability magnetic function.

The centering support 4 is sandwiched between the first diaphragm 21 and the voice coil 23. The centering support 4 includes a first fixed portion 41 fixedly connected to the frame 1, a second fixed portion 42 spaced apart from the first fixed portion 41 and fixedly connected to the voice coil 23, several connecting arms 43 connecting the second fixed portion 42 with the first fixed portion 41, and a pad portion 44 extending from the first fixed portion 41 in a direction facing towards the second fixed portion 42. The first fixed portion 41, the second fixed portion 42, the connecting arms 43, and the pad portion 44 are formed into one piece.

For example, the first fixed portion 42 is disposed between the fixing portion 211 and the frame 1, and the second fixed portion 41 is sandwiched between the dome portion 213 and the voice coil 23.

The connecting arms 43 are suspended in the receiving space, and each of the connecting arms 43 includes a first part 431 fixedly connected to the first fixed portion 41, a second part 432 formed by being bent and extending from an end of the first part 431 facing away from the first fixed portion 41, and a third part 433 formed by being bent and extending from an end of the second part 432 facing away from the first part 431 and fixedly connected to the second fixed portion 42. The second part 432 is perpendicular to the first part 431, and the third part 433 is perpendicular to the second part 432.

The number of the connecting arms 43 is four. One end of each of the connecting arms 43 is fixedly connected to the first fixed portion 41, and the other end is fixedly connected to the second fixed portion 42. In this way, four sides of the first fixed portion 41 and four sides of the second fixed portion 42 are all connected to the connecting arms 43. The connecting arms 43 are formed through multiple times of bending, which increases the elasticity of the centering support 4, thereby increasing the amount of vibration of the vibration unit 2, and improving the acoustic performance of the speaker 100.

Further, the pad portion 44 of the centering support 4 is fixed to the frame 1 by welding. The connecting arms 43 are located above and distributed around the main magnet 32, and are spaced apart from the main magnet 32, completely avoiding the position of the main magnet 32. As a result, the size of the main magnet 32 can be further increased, and thus the number of magnetic lines of the magnetic circuit unit can be increased, thereby enhancing the space utilization and sensitivity of the speaker 100, and improving the acoustic performance of the speaker 100.

Figure 4:
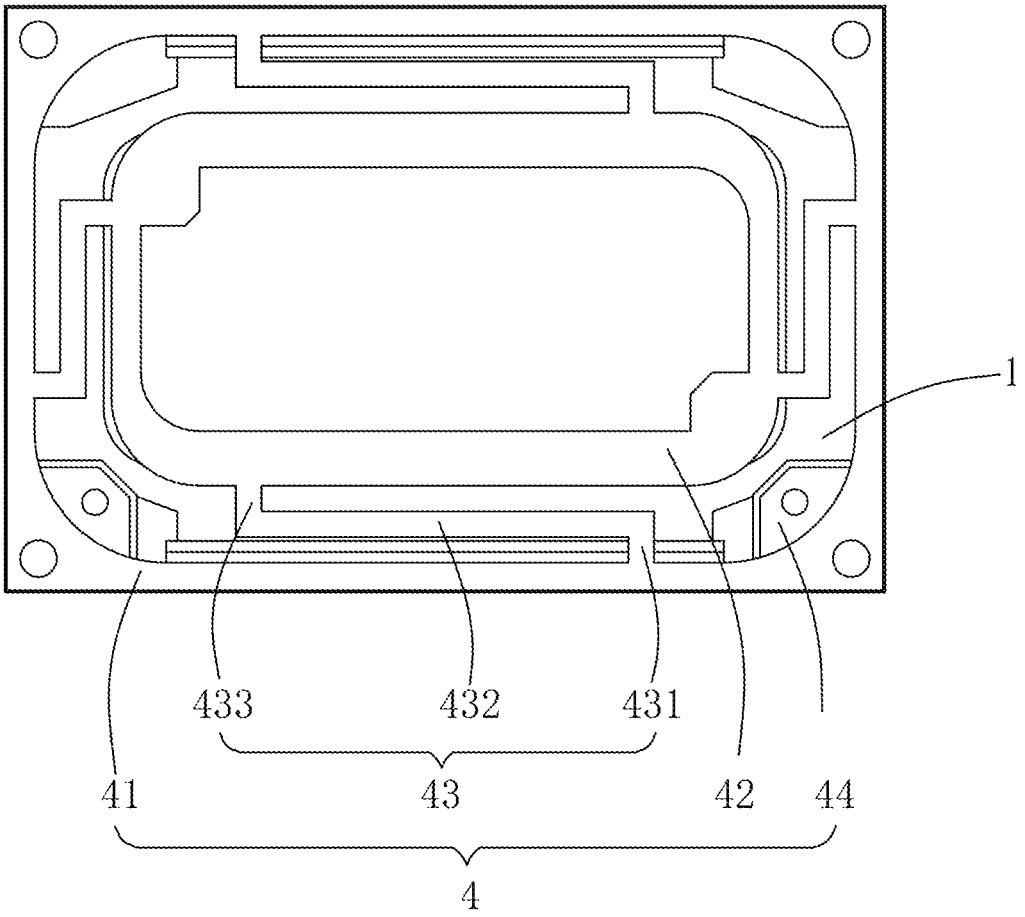
FIG. 4 is a schematic diagram illustrating a connection relationship between a pad portion and a frame as shown in FIG. 2.

Referring to FIG. 4, the centering support 4 is fixedly connected to the frame 1 through the pad portion 44. For example, the centering support 4 is connected to the frame 1 by welding.

Furthermore, the centering support 4 is a flexible circuit board, and is electrically connected to the voice coil 23.

The conductive terminal 5 is embedded in the frame 1, for electrically connecting the voice coil 23 with the outside. For example, the conductive terminal 5 is electrically connected to the centering support 4.

Compared with the related art, in the speaker 100 provided by the present disclosure, by sandwiching the centering support 4 between the voice coil 23 and the first diaphragm 21, the positional conflict between the centering support 4 and the main magnet 32 is avoided, the size of the main magnet 32 can be further increased, thereby enhancing the space utilization and sensitivity of the speaker 100, and improving the acoustic performance of the speaker 100.

The above merely are the embodiments of the present disclosure, and it should be noted that those skilled in the art also can make improvements, without departing from the creative conception of the present disclosure, which all shall fall within the scope of the present disclosure.

What is claimed is:

1. A speaker, comprising:

a frame having a receiving space;

a vibration unit received in the receiving space;

a magnetic circuit unit configured to drive the vibration unit to vibrate and emit sound; and a centering support, wherein the vibration unit comprises a first diaphragm configured to vibrate and emit sound, and a voice coil disposed under the first diaphragm and configured to drive the first diaphragm to vibrate and emit sound, the vibration unit further comprises a second diaphragm disposed opposite to the first diaphragm, and the second diaphragm has one end fixedly connected to the frame and another end fixedly connected to the voice coil, the centering support is sandwiched between the first diaphragm and the voice coil, and the voice coil is electrically connected to an external circuit through the centering support.

2. The speaker as described in claim 1, wherein the centering support comprises a first fixed portion fixedly connected to the frame, a second fixed portion spaced apart from the first fixed portion and fixedly connected to the voice coil, connecting arms connecting the second fixed portion with the first fixed portion, and a pad portion extending from the first fixed portion in a direction facing towards the second fixed portion, and wherein the first fixed portion, the second fixed portion, the connecting arms, and the pad portion are formed into one piece.

3. The speaker as described in claim 2, wherein the first fixed portion is a rectangular ring, the second fixed portion is a rectangular ring, and the second fixed portion is disposed at an inner side of the first fixed portion with an interval.

4. The speaker as described in claim 3, wherein the connecting arms comprises four connecting arms, each of the four connecting arms has one end fixedly connected to the first fixed portion, and another end fixedly connected to the second fixed portion.

5. The speaker as described in claim 2, wherein each of the connecting arms comprises a first part fixedly connected to the first fixed portion, a second part formed by being bent and extending from an end of the first part facing away from the first fixed portion, and a third part formed by being bent and extending from an end of the second part facing away from the first part and fixedly connected to the second fixed portion, and wherein the second part is perpendicular to the first part, and the third part is perpendicular to the second part.

6. The speaker as described in claim 2, wherein the first diaphragm comprises a fixing portion fixedly connected to the first fixed portion, a suspension portion connected to the fixing portion, and a dome portion connected to the suspension portion, the suspension portion being spaced apart from the connecting arms, and the dome portion abutting against the second fixed portion.

7. The speaker as described in claim 2, wherein the pad portion of the centering support is fixed to the frame by welding.

8. The speaker as described in claim 1, wherein the centering support is a flexible circuit board.

9. The speaker as described in claim 1, further comprising a conductive terminal for electrically connecting the vibration unit with outside, the conductive terminal being embedded in the frame.

* * * * *